US006555304B1

(12) United States Patent
Isaac et al.

(10) Patent No.: US 6,555,304 B1
(45) Date of Patent: Apr. 29, 2003

(54) DIRECT VIEW PHOTOGRAPHIC ELEMENT CONTAINING A PARTICULAR RED RECORD

(75) Inventors: Walter H. Isaac, Penfield, NY (US); Vincent J. Flow, Holley, NY (US); James S. Honan, Spencerport, NY (US); Jeffrey C. Smitley, Rochester, NY (US); Patrick W. Webber, Rochester, NY (US); Glenn M. Brown, Rochester, NY (US); Cynthia A. Fitzgerald, Rochester, NY (US); Jess B. Hendricks, Rochester, NY (US); Thomas A. Rosiek, Rochester, NY (US); John H. Harder, Rochester, NY (US); Carolyn H. Ellinger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/051,531

(22) Filed: Jan. 18, 2002

(51) Int. Cl.[7] ..... G03C 1/46

(52) U.S. Cl. ..... 430/505; 430/552; 430/553; 430/558; 430/523; 430/631

(58) Field of Search ..... 430/505, 552, 430/553, 554, 555, 558, 523, 631

(56) References Cited

U.S. PATENT DOCUMENTS

| | | | | | |
|---|---|---|---|---|---|
| 5,047,314 | A | | 9/1991 | Sakai et al. | |
| 5,350,650 | A | * | 9/1994 | Gasper et al. | 430/502 |
| 5,420,003 | A | * | 5/1995 | Gasper et al. | 430/503 |
| 5,925,503 | A | | 7/1999 | Harder et al. | |
| 5,962,198 | A | | 10/1999 | Lau et al. | |
| 5,972,574 | A | | 10/1999 | Fischer et al. | |
| 6,110,658 | A | * | 8/2000 | Honan et al. | 430/553 |
| 6,132,947 | A | * | 10/2000 | Honan et al. | 430/552 |
| 6,261,755 | B1 | * | 7/2001 | Gibson et al. | 430/549 |

* cited by examiner

*Primary Examiner*—Geraldine Letscher
(74) *Attorney, Agent, or Firm*—Arthur E. Kluegel

(57) ABSTRACT

Disclosed is a silver halide direct view multicolor photographic element comprising a red record containing (1) a red light sensitized silver halide emulsion, (2) a cyan dye-forming NB first coupler, and (3) a second coupler selected from (a) a magenta dye forming coupler in an amount of 2–30 mole % of the total coupler in the red record and (b) a cyan dye-forming coupler having a greater absorption in the green spectra than the first coupler in an amount sufficient to provide a Status A green density in the range of 0.27 to 0.40 using a red light separation exposure at a Status A red density of 1.0. Such an element exhibits improved flesh tone reproduction and good dye dark stability.

23 Claims, No Drawings

DIRECT VIEW PHOTOGRAPHIC ELEMENT CONTAINING A PARTICULAR RED RECORD

CROSS-REFERENCE TO RELATED APPLICATIONS

This application is being cofiled with an application under directed to a direct view photographic element containing a particular green record.

FIELD OF THE INVENTION

This invention relates to a direct view silver halide photographic element containing a particular red record that contains a desirable combination of couplers.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer then reacts with one or more incorporated dye-forming couplers to form an imagewise distribution of dye.

In any polychromatic chromogenic photographic element designed for direct view, it is desirable to accurately reproduce the hue of flesh tones of different densities. Direct view elements are more fully defined hereinafter to include reproductions intended for human viewing such as prints, projection images and transparencies such as back-lit signs. These photographic elements are distinguished from the so-called image capture elements that are used only as an intermediate to produce direct view elements via optical or digital printing methods.

It is also desirable to accurately reproduce neutral backgrounds in scenes when the photographic material is balanced to a pleasing flesh tone. This is especially true for wedding portraits and similar images where the blacks and whites must be accurately reproduced.

Finally, besides providing images with desirable flesh hue and neutrals, it is also desirable to provide images with satisfactory image stability. Images that fade unduly under dark conditions are undesirable. It is a therefore a desire to provide the foregoing flesh reproduction without sacrificing image stability.

It has been suggested to employ pyrazolotriazole magenta dye-forming couplers in the green record of direct view elements. It has also been suggested to employ certain so-called 2,5-diacylamino cyan couplers in the red record of direct view elements. See for example U.S. Pat. Nos. 5,925,503; 5,972,574; and 5,962,198. It has also been suggested to use a combination of phenolic couplers in a red record in U.S. Pat. No. 5,047,314.

It is a problem to be solved to provide a direct view multicolor element that provides improved flesh tone reproduction and good dye dark stability.

SUMMARY OF THE INVENTION

The invention provides a silver halide direct view multicolor photographic element comprising a red record containing (1) a red light sensitized silver halide emulsion, (2) a cyan dye-forming NB first coupler, and (3) a second coupler selected from (a) a magenta dye forming coupler in an amount of 2–30 mole % of the total coupler in the red record and (b) a cyan dye-forming coupler having a greater absorption in the green spectra than the first coupler in an amount sufficient to provide a Status A green density in the range of 0.27 to 0.40 using a red light separation exposure at a Status A red density of 1.0.

Embodiments of the invention provide direct view elements that exhibit improved flesh tone reproduction and good dye dark stability.

DETAILED DESCRIPTION OF THE INVENTION

The invention is generally as described above. The multicolor elements of the invention comprise a blue record sensitized for maximum sensitivity in the range of 400–500 nm, a green record sensitized for maximum sensitivity in the range of 500–600 nm, and a red record sensitized for maximum sensitivity in the range of 600–700 nm. The present invention provides for the selection of the dye forming couplers in the red record to enable an improved flesh tone reproduction and good dye dark stability.

An "NB coupler" is a narrow bandwidth coupler having substituents so that there is a reduction in left bandwidth in spin-coating form vs. solution form of at least 5 nm. In accordance with the procedure, a dye is formed by combining the coupler and the developer 4-amino-3-methyl-N-ethyl-N-(2-methanesulfonamidoethyl) aniline sesquisulfate hydrate. If the left bandwidth (LBW) of its absorption spectra upon "spin coating" of a 3% w/v solution of the dye in di-n-butyl sebacate solvent is at least 5 nm. less than the LBW for a solution of the same dye in acetonitrile, then the coupler is an "NB Coupler". The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in acetonitrile solution.

In the invention, the photographic element comprises a red record containing a red light sensitized silver halide emulsion, a cyan dye-forming NB coupler, and at least one of (a) a magenta dye forming coupler or (b) a cyan dye-forming coupler having a greater absorption in the green spectra than the first coupler. Such a coupler is typically not an NB coupler. The cyan dye-forming second coupler to be included in the cyan layer is one sufficient to provide for the record a status A green density of 0.27–0.40 using a red light separation exposure at a red density of 1.0. The value is typically in the range of 0.29–0.38.

The cyan dye-forming coupler useful to be included in the cyan record is a phenolic, naphtholic or pyrroloazole coupler. A particularly useful phenolic coupler is a 2,5-diacylamino phenol, or a 2-ureido-5-acylamino phenol. The amount of the cyan dye-forming second coupler to be included in the red record is suitably in the amount of 5–75 mole % of the couplers in the record and typically 10–65 mole %.

The magenta dye-forming coupler in the cyan record is suitably any magenta dye-forming coupler, such as an azole coupler. Examples are pyrazolone and pyrazoloazole couplers. One type of suitable coupler is a pyrazolotriazole coupler, particularly one with a tetramethylethyl link. Examples of pyrazolo couplers include a 1H-pyrazolo (5,1-c) [1,2,4] triazole or a 1H-pyrazolo (1,5-b) [1,2,4] triazole compound. The amount of the magenta coupler in the cyan record is suitably in the range of 2–30 mole % of the couplers in the record with 2–25 or 5–20% typically preferred.

The magenta dye-forming coupler to be used in the magenta record is suitably an azole coupler. One type of suitable coupler is a pyrazolotrazole coupler, particularly one with a tetramethylethyl link. Examples include a 1H-pyrazolo (5,1-c) [1,2,4] triazole or a 1H-pyrazolo (1,5-b) [1,2,4] triazole compound.

In one desirable embodiment of the invention, the green record contains a magenta dye-forming coupler such that the element exhibits a Status A red density greater than 0.23 at a green density of 1.0, as measured using a green light separation exposure. Desirably, the red density is greater than 0.24 or 0.25 and is less than 0.40.

In another desirable embodiment of the invention, the green record contains a magenta dye-forming coupler and a cyan dye-forming coupler in an amount of at least 0.1 mole % of the couplers present in the green record.

It is important to closely match the coupler reactivity when blending couplers. Mis-matched blended coupler reaction rates with oxidized color developer will result in color shifts through the neutral density scale. Reactivity mismatches can also result in unacceptable color reproduction performance. Ideally the coupler blends would react to form one blended dye spectra that forms the same blended dye spectra up and down the density scale. In practice some deviation from one blended dye spectra can occur. If the dye spectra deviation is not too large the tone scale neutrality and color reproduction properties will be acceptable.

Embodiments of the invention may provide a combination of improved flesh tone reproduction and image stability. In such cases, the use, as image couplers, of an NB 2,5-diacylamino phenolic coupler in the cyan record and the pyrazolotriazole coupler with a tetramethylethyl link in the magenta record is preferred.

A useful embodiment of the invention incorporates a block copolymers of polyoxypropylene and polyoxyethylene in one of the layers such as in the overcoat. Examples of such materials are described in U.S. Pat. No. 5,491,052 and include Pluronic L44 of BASF Inc.

Unless otherwise specifically stated, use of the term "group", "substituted" or "substituent" means any group or atom other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-etbylbexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials useful in the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771, 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138, U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

It is contemplated that the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure,* Item 38755, September 1996, I. Emulsion grains and their preparation.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES
The structures of magenta, cyan, and yellow couplers used in the example are shown below:
MC-1
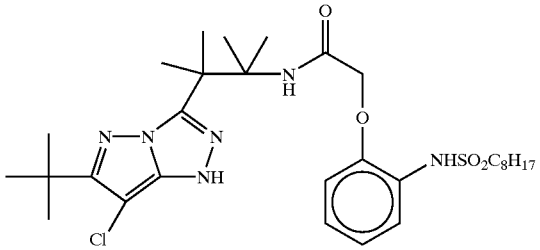
MC-2
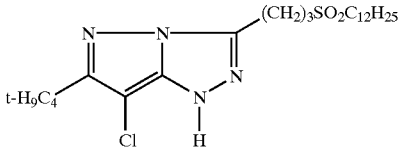
CC-1
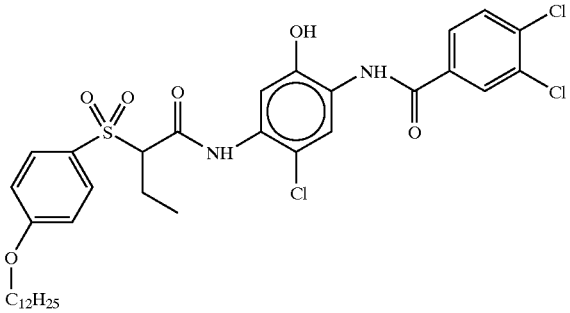
CC-2
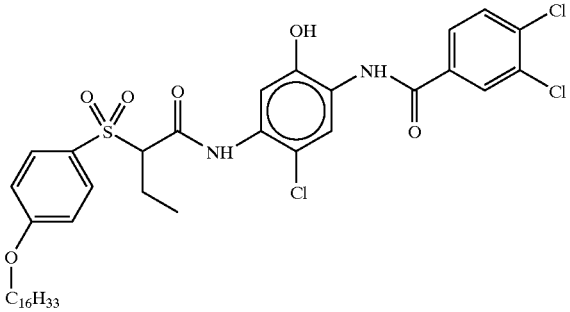
CC-3
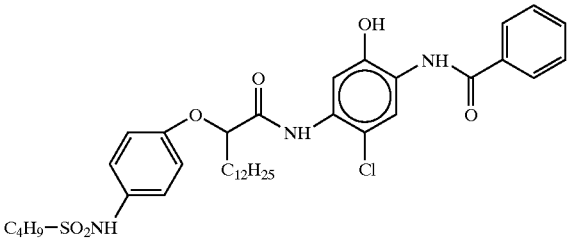
-continued
CC-4
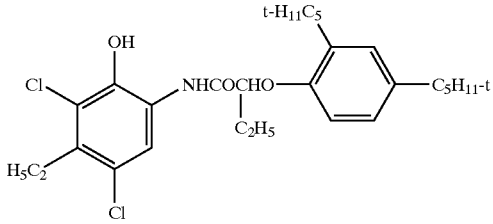
CC-5
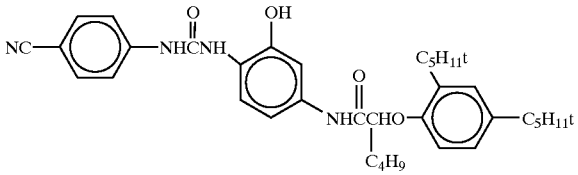
YC1
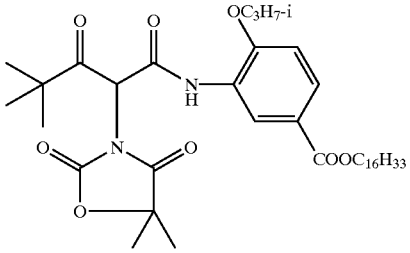
YC2
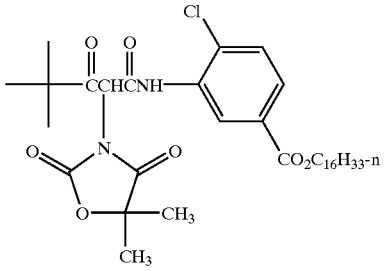
Conventional coupler solvents used in the examples are the following:
CS-1
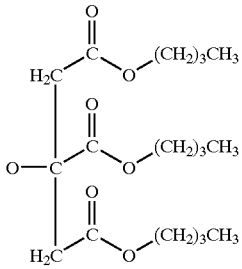
CS-2
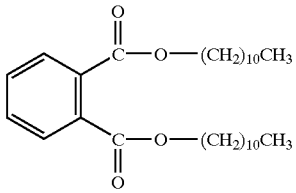

-continued
CS-3
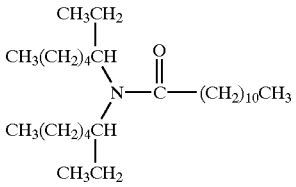
CS-4
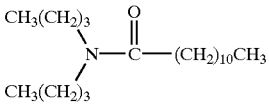
CS-5
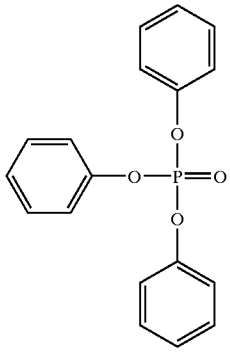
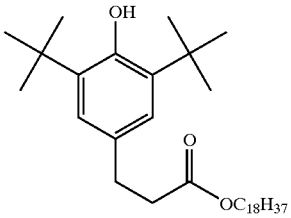
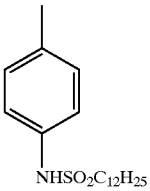
-continued
CS-6
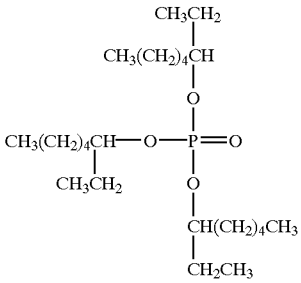
CS-7
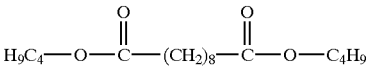
CS-8
CS-9
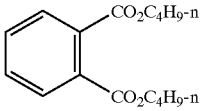
CS-10
CS-11
Coupler stabilizers shown in the examples are the following:
ST-1
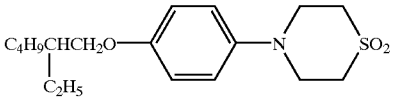
ST-2
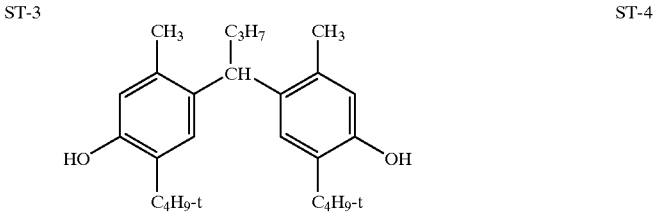
ST-3
ST-4

-continued

ST-5

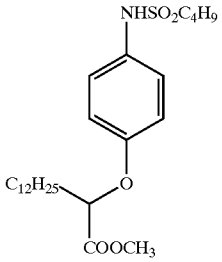

ST-6

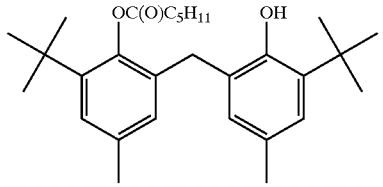

ST-7

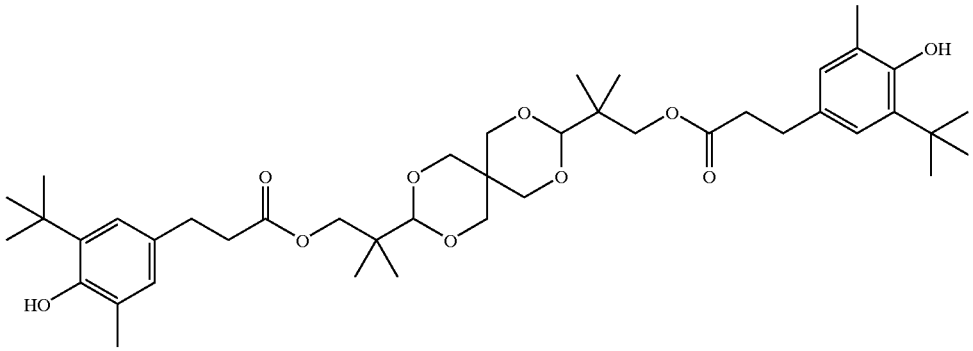

ST-8

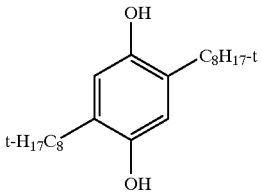

ST-9

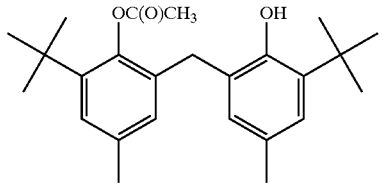

UV-1

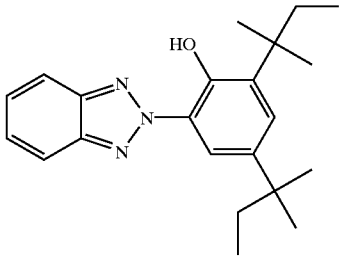

UV-2

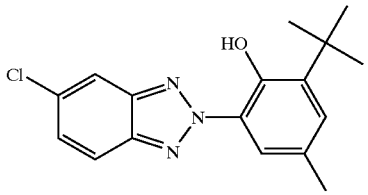

Dispersions were prepared for coating examples 101 through 405 per the following:

Ultraviolet absorber dispersion UV-1 was prepared by dissolving 110.9 g of UV-1, 19.6 g of UV-2 and 35.7 g of ST-8 in 43.5 g of CS-6 and heating to 116° C. This oil phase was added to an aqueous gelatin solution containing 87.0 g of a deionized bone gelatin, 70.0 g of a 10% aqueous solution of surfactant Alkanol-XC (Dupont), 7.2 g of a 10% sodium propionate solution, 9.3 g of 2N propionic acid and 616.8 g of water, while held at 80° C. The resulting mixture was subjected to a Brinkmann rotor-stator mixer, set at 8000 rpm for 2 minutes. This mixture was then homogenized by passing once through a multiple orifice device at 352 kg/cm$^2$, at a temperature of 80° C.

Interlayer scavenger dispersion IL-1 was prepared by dissolving 80.08 g of ST-8 and 12.1 g of ST-1 in 121.2 g of CS-5 and heating to 110° C. This oil phase was added to an aqueous gelatin solution containing 85.6 g of a deionized bone gelatin, 62.5 g of a 10% aqueous solution of surfactant Alkanol-XC (Dupont), 10.3 g of 2N propionic acid and 627.8 of water, while held at 80° C. The resulting mixture was subjected to a Brinkmann rotor-stator mixer, set at 8000 rpm for 2 minutes. This mixture was then homogenized by passing once through a multiple orifice device at 352 kg/cm$^2$, at a temperature of 80° C.

Coupler dispersion YD-1 was prepared by dissolving 15.8 g of coupler YC2, 3.76 g of stabilizer ST-2, 0.94 g of ST-6 and 6.58 g of ST-9 in 8.31 g of solvent CS-1 at 110° C. An aqueous gelatin solution of 13.08 g gelatin, 85.44 g water, 1.51 g propionic acid (2N), and 18.47 g of a 10% aqueous solution of ionic surfactant (Alkanol-XC) was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 563 kg/cm$^2$, at a temperature of 75° C.

Coupler dispersion YD-2 was prepared by dissolving 15.8 g of coupler YC2, 2.20 g of stabilizer ST-2, 0.55 g of ST-6 and 3.86 g of ST-9 in 6.04 g of solvent CS-1 at 110° C. An aqueous gelatin solution of 10.51 g gelatin, 68.68 g water, 1.21 g propionic acid (2N), and 14.8 g of a 10% aqueous solution of ionic surfactant (Alkanol-XC) was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 563 kg/cm$^2$, at a temperature of 75° C.

Coupler dispersion YD-3 was prepared by dissolving 15.8 g of coupler YC2, 2.19 g of stabilizer ST-2, 2.19 g of ST-7 and 2.19 g of ST-9 in 6.04 g of solvent CS-1 at 110° C. An aqueous gelatin solution of 10.51 g gelatin, 68.68 g water, 1.21 g propionic acid (2N), and 14.8 g of a 10% aqueous solution of surfactant Alkanol-XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 563 kg/cm$^2$, at a temperature of 75° C.

Coupler dispersion YD-4 was prepared by dissolving 15.8 g of coupler YC1, 2.19 g of stabilizer ST-2, 2.19 g of ST-7 and 2.19 g of ST-9 in 6.04 g of solvent CS-1 at 110° C. An aqueous gelatin solution of 10.51 g gelatin, 68.68 g water, 1.21 g propionic acid (2N), and 14.8 g of a 10% aqueous solution of surfactant Alkanol-XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 563 kg/cm$^2$, at a temperature of 75° C.

ST-9 may be prepared as follows: To 82.6 g (0.24 mol) 2,2'-methylenebis(4-methyl-6-tert-butylphenol) in 50 ml of heptane containing 10 g (0.10 mol) potassium acetate at 50° C. is slowly added 30.9 g (0.30 mol) acetic anhydride with stirring. The temperature is raised to 105° C. and the reaction continues for 5 hours. After water washes the reaction is cooled to 12° C. The product is collected by filtration, washed with chilled methanol and then with a chilled mixture of methanol and water. After drying at 40° C. under vacuum, 77.1 g (83.4%) of 2-((2-(acetyloxy)-3-(1,1-dimethylethyl)-5-methylphenyl)methyl)-6-(1,1-dimethylethyl)-4-methylphenol is collected. Other bisphenolic compounds can be reacted in a similar way.

Magenta coupler dispersion MD-1 was prepared by dissolving 27.73 g of coupler MC-1, 8.98 g of stabilizer ST-2 and 23.19 g of stabilizer ST3 in a mixture of 17.02 g of CS-2 and 33.05 g CS-8, at 135° C. This oil phase was added to an aqueous gelatin solution containing 39.50 g of a deionized bone gelatin, 31.25 g of a 10% aqueous solution of surfactant Alkanol-XC and 319.2 g of water, while held at 80° C. The resulting mixture was subjected to a Brinkmann rotor-stator mixer, set at 8000 rpm for 2 minutes. This mixture was then homogenized by twice passing through a Microfluidics Microfluidizer at 563 kg/cm$^2$, at a temperature of 75° C.

Magenta dispersions MD-2 through MD-4 were prepared in a similar manner to dispersion MD-1. The formula details for dispersions MD-1 through MD-9 are summarized in Table MD.

Table MD:
Summary of Magenta Dispersion Formulas MD-1 through MD-4.

| Compound | MD-1 | MD-2 | MD-3 | MD-4 |
|---|---|---|---|---|
| MC-1 | 27.73 | 29.12 | 29.01 | 27.64 |
| CC-4 | 0.00 | 0.00 | 0.41 | 0.39 |
| ST-2 | 8.98 | 9.43 | 9.40 | 8.96 |
| ST-3 | 23.19 | 18.86 | 18.80 | 23.11 |
| CS-2 | 17.02 | 17.87 | 17.80 | 16.96 |
| CS-8 | 33.05 | 34.71 | 34.58 | 32.95 |
| Oil Temp ° C. | 135 | 135 | 145 | 145 |
| Gelatin | 39.50 | 39.50 | 39.50 | 39.50 |
| 10% Alkanol XC | 31.25 | 31.25 | 31.25 | 31.25 |
| Water | 319.2 | 319.2 | 319.2 | 319.2 |

The coupler dispersion CD-2 was prepared by dissolving 23.05 g of coupler CC-1, 2.56 g of coupler CC-2, and 35.22 g of UV-1 in 29.36 g and 9.81 g of solvents CS-7 and CS-6, respectively, at 145° C. This oil phase was added to an aqueous gelatin solution containing 40.00 g of gelatin, 45.00 g of a 10% aqueous solution of surfactant Alkanol-XC and 315.0 g of water, while held at 80° C. The resulting mixture was subjected to a Brinkmann rotor-stator mixer, set at 8000 rpm for 2 minutes. This mixture was then homogenized by twice passing through a Microfluidics Microfluidizer at 563 kg/cm$^2$ (8000 psi), at a temperature of 75° C.

Cyan dispersions CD-1 through CD-10 were prepared in a similar manner to dispersion CD-1. The formula details for dispersions CD-1 through CD-10 are summarized in Table CD. Cyan dispersion CD-11 was prepared by dissolving 21.0 g of coupler CC-5 in 21.0 g of CS-7 and 42.0 g of CS-11, at 66° C. This oil phase was added to an aqueous gelatin solution containing 28.0 g of gelatin, 14.0 g of a 10% aqueous solution of surfactant Alkanol-XC and 224.0 g of water, while held at 46° C. The resulting mixture was then subjected to 3 passes through a rotor-stator mixer and collected. This dispersion was then placed in a rotor-evaporator and the CS-11 was removed under mild vacuum, while being held at 65° C. The removed CS-11 is then replaced with an equal quantity of water to reconstituted the dispersion back to the aim coupler/gel concentrations.

TABLE

CD: Summary of Cyan Dispersion Formulas CD-1 through CD-10.

| Compound | CD-1 | CD-2 | CD-3 | CD-4 | CD-5 | CD-6 | CD-7 | CD-8 | CD-9 | CD-10 |
|---|---|---|---|---|---|---|---|---|---|---|
| CC-1 | 0.00 | 23.05 | 21.62 | 18.95 | 15.42 | 29.11 | 21.11 | 11.41 | 6.53 | 0.00 |
| CC-2 | 0.00 | 2.56 | 0.00 | 0.00 | 0.00 | 3.23 | 0.00 | 0.00 | 0.00 | 0.00 |
| CC-3 | 0.00 | 0.00 | 0.00 | 4.57 | 8.01 | 0.00 | 10.96 | 20.44 | 25.19 | 31.56 |
| CC-4 | 41.29 | 0.00 | 0.00 | 0.00 | 0.00 | 0.00 | 0.00 | 0.00 | 0.00 | 0.00 |
| UV-1 | 26.59 | 35.22 | 29.73 | 36.19 | 36.25 | 32.02 | 32.15 | 32.27 | 32.32 | 32.40 |
| ST-8 | 0.34 | 0.00 | 0.00 | 0.00 | 0.00 | 0.00 | 0.00 | 0.00 | 0.00 | 0.00 |

TABLE-continued

CD: Summary of Cyan Dispersion Formulas CD-1 through CD-10.

| Compound | CD-1 | CD-2 | CD-3 | CD-4 | CD-5 | CD-6 | CD-7 | CD-8 | CD-9 | CD-10 |
|---|---|---|---|---|---|---|---|---|---|---|
| CS-7 | 0.00 | 29.36 | 36.48 | 30.18 | 30.23 | 26.70 | 26.81 | 26.91 | 26.95 | 27.01 |
| CS-6 | 0.00 | 9.81 | 8.12 | 10.09 | 10.10 | 8.93 | 8.96 | 9.00 | 9.01 | 9.03 |
| CS-9 | 40.46 | 0.00 | 0.00 | 0.00 | 0.00 | 0.00 | 0.00 | 0.00 | 0.00 | 0.00 |
| CS-10 | 3.39 | 0.00 | 0.00 | 0.00 | 0.00 | 0.00 | 0.00 | 0.00 | 0.00 | 0.00 |
| Oil Temp ° C. | 141 | 145 | 145 | 145 | 145 | 145 | 145 | 145 | 145 | 145 |
| Gelatin | 41.29 | 40.00 | 40.00 | 40.00 | 40.00 | 40.00 | 40.00 | 40.00 | 40.00 | 40.00 |
| 10% Alkanol XC | 48.64 | 45.00 | 45.00 | 45.00 | 45.00 | 45.00 | 45.00 | 45.00 | 45.00 | 45.00 |
| Water | 297.9 | 315.0 | 315.0 | 315.0 | 315.0 | 315.0 | 315.0 | 315.0 | 315.0 | 315.0 |
| Propionic acid (2N) | 5.51 | 0.00 | 0.00 | 0.00 | 0.00 | 0.00 | 0.00 | 0.00 | 0.00 | 0.00 |
| 10% sodium propionate | 3.34 | 0.00 | 0.00 | 0.00 | 0.00 | 0.00 | 0.00 | 0.00 | 0.00 | 0.00 |

The compounds useful in the formulations were prepared in the manner well-known in the art or purchased. ST-9 may be prepared as follows:

To 82.6 g (0.24 mol) 2,2'-methylenebis(4-methyl-6-tert-butylphenol) in 50 ml of heptane containing 10 g (0.10 mol) potassium acetate at 50C. is slowly added 30.9 g (0.30 mol) acetic anhydride with stirring. The temperature is raised to 105C. and the reaction continues for 5 hours. After water washes the reaction is cooled to 12C. The product is collected by filtration, washed with chilled methanol and then with a chilled mixture of methanol and water. After drying at 40C. under vacuum, 77.1 g (83.4%) of 2-((2-(acetyloxy)-3-(1,1-dimethylethyl)-5-methylphenyl)methyl)-6-(1,1-dimethylethyl)-4-methylphenol is collected. Other bisphenolic compounds can be reacted in a similar way.

The coating structure for coating example 201 is shown below. This same basic coating structure was used for coating examples 101–405. The layer 2, layer 4, layer 6 and layer 7 formulations were the same for all coating examples 101 through 405. There were some small blue sensitive layer #1 differences in coating examples 101–405 as outlined in Table #1. The green sensitive layer 3 and red sensitive layer 5 formulations are summarized in Table #3 and Table #4.

Each of these cyan, magenta and yellow coupler dispersions was diluted further with aqueous gelatin and mixed with a chemically and spectrally sensitized cubic silver chloride photographic emulsion. The mixing of the already molten components within each imaging layer was carried out immediately prior to coating. The red and green sensitive emulsions had an average edge length of 0.38 $\mu$m. During the chemical and spectral sensitization process 1.6 mole % bromide was added to the red sensitive emulsion and 1.2 mole % bromide was added to the green sensitive emulsion. The blue sensitive layer 1 emulsion was a cubic mono dispersed silver chloro-iodide emulsion with 99.8 mole % chloride and 0.20 mole % iodide with an average edge length 0.61 $\mu$m. During the chemical and spectral sensitization process a small amount of bromide was added to the blue sensitive emulsion.

Within each group of coatings the silver was adjusted in the cyan, magenta and yellow imaging layers so that each coating reproduced a neutral scale that visually matched the other coatings within the group. Individual coupler coverages in the red and green photosensitive layers for the various coatings are reported Table 2 and Table 3. Solvent and stabilizer coverages for the green and red sensitive layers are defined by the dispersion identity and composition shown in Table MD and Table CD.

EXAMPLE 1

Coating Structure, Example 201

| | |
|---|---|
| Layer 7 (Supercoat) | |
| Colloidal silica | 0.1614 g · m$^{-2}$ |
| Gel | 0.6456 g · m$^{-2}$ |
| Nonionic Surfactant as Pluoronic L44 | 0.1183 g · m$^{-2}$ |
| Layer 6 (LV Layer) | |
| UV-1 | 0.130 g · m$^{-2}$ |
| UV-2 | 0.023 g · m$^{-2}$ |
| ST-8 | 0.042 g · m$^{-2}$ |
| CS-6 | 0.051 g · m$^{-2}$ |
| Gel | 0.527 g · m$^{-2}$ |
| Layer 5 (Red-sensitive Layer) | |
| Ag | 0.256 g · m$^{-2}$ |
| Coupler CC-1 | 0.387 g · m$^{-2}$ |
| Coupler CC-2 | 0.043 g · m$^{-2}$ |
| UV-1 | 0.591 g · m$^{-2}$ |
| CS-6 | 0.165 g · m$^{-2}$ |
| CS-7 | 0.493 g · m$^{-2}$ |
| Gel | 2.303 g · m$^{-2}$ |
| Layer 4 (Interlayer B) | |
| ST-8 | 0.086 g · m$^{-2}$ |
| CS-5 | 0.129 g · m$^{-2}$ |
| ST-1 | 0.013 g · m$^{-2}$ |
| Gel | 0.753 g · m$^{-2}$ |
| Layer 3 (Green-sensitive Layer) | |
| Ag | 0.141 g · m$^{-2}$ |
| Coupler MC-1 | 0.269 g · m$^{-2}$ |
| ST-2 | 0.087 g · m$^{-2}$ |
| ST-3 | 0.224 g · m$^{-2}$ |
| CS-8 | 0.321 g · m$^{-2}$ |
| CS-2 | 0.165 g · m$^{-2}$ |
| Gel | 1.441 g · m$^{-2}$ |
| Layer 2 (Interlayer A) | |
| ST-8 | 0.086 g · m$^{-2}$ |
| CS-5 | 0.129 g · m$^{-2}$ |
| ST-1 | 0.013 g · m$^{-2}$ |
| Gel | 0.753 g · m$^{-2}$ |
| Layer 1 (Blue-sensitive Layer) | |
| Ag | 0.249 g · m$^{-2}$ |
| Coupler YC-2 | 0.570 g · m$^{-2}$ |

-continued

| | |
|---|---|
| ST-2 | 0.0795 g · $m^{-2}$ |
| ST-6 | 0.0199 g · $m^{-2}$ |
| ST-9 | 0.1391 g · $m^{-2}$ |
| CS-1 | 0.218 g · $m^{-2}$ |
| HQ-K | 0.0009 g · $m^{-2}$ |
| MHR* | 0.0064 g · $m^{-2}$ |
| Gel | 1.345 g · $m^{-2}$ |
| Hardener | 0.151 g · $m^{-2}$ |
| Support | |

*MHR = 2,5-dihydroxy-5-methyl-3-(4-morpholinyl)-2-cyclopenten-1-one
HQ-K = 2,5-dihydroxy-4-(1-methylheptadecyl)-benzenesulphonic acid (K salt)
Hardener = bis(vinylsulphonyl)methane
Surfactant = Block copolymer of propylene oxide and ethylene oxide.

Coating surfactants were added to facilitate coating as is conventional in the art.

TABLE #1

Blue Sensitive "Layer 1" Formula for Examples 101 through Example 405:

| Coating ID | Layer 1 Yellow Dispersion | Layer 1 Yellow Coupler | Layer 1 Yellow Coupler g/$m^2$ | Layer 1 Gelatin g/$m^2$ | Layer 1 Silver g/$m^2$ |
|---|---|---|---|---|---|
| 101 | YD-1 | YC-2 | 0.570 | 1.280 | 0.266 |
| 102 | YD-1 | YC-2 | 0.570 | 1.266 | 0.261 |
| 103 | YD-1 | YC-2 | 0.570 | 1.280 | 0.266 |
| 104 | YD-1 | YC-2 | 0.570 | 1.283 | 0.267 |
| 105 | YD-1 | YC-2 | 0.570 | 1.280 | 0.266 |
| 106 | YD-1 | YC-2 | 0.570 | 1.280 | 0.266 |
| 201 | YD-2 | YC-2 | 0.570 | 1.335 | 0.249 |
| 202 | YD-2 | YC-2 | 0.570 | 1.335 | 0.249 |
| 203 | YD-2 | YC-2 | 0.570 | 1.335 | 0.249 |
| 301 | YD-3 | YC-2 | 0.570 | 1.396 | 0.270 |
| 302 | YD-3 | YC-2 | 0.570 | 1.396 | 0.270 |
| 303 | YD-3 | YC-2 | 0.570 | 1.396 | 0.270 |
| 401 | YD-3 | YC-2 | 0.570 | 1.382 | 0.265 |

TABLE #1-continued

Blue Sensitive "Layer 1" Formula for Examples 101 through Example 405:

| Coating ID | Layer 1 Yellow Dispersion | Layer 1 Yellow Coupler | Layer 1 Yellow Coupler g/$m^2$ | Layer 1 Gelatin g/$m^2$ | Layer 1 Silver g/$m^2$ |
|---|---|---|---|---|---|
| 402 | YD-3 | YC-2 | 0.570 | 1.382 | 0.265 |
| 403 | YD-4 | YC-1 | 0.645 | 1.543 | 0.295 |
| 404 | YD-3 | YC-2 | 0.570 | 1.382 | 0.265 |
| 405 | YD-3 | YC-2 | 0.570 | 1.382 | 0.265 |

TABLE 2

Green Sensitive "Layer 3" Formula for Examples 101 through Example 405:

| Coating ID | Layer 3 Primary Magenta Dispersion | Layer 3 MC-1 g/$m^2$ | Layer 3 Gelatin g/$m^2$ | Layer 3 Silver g/$m^2$ |
|---|---|---|---|---|
| 101 | MD-1 | 0.269 | 1.441 | 0.141 |
| 102 | MD-1 | 0.269 | 1.428 | 0.138 |
| 103 | MD-1 | 0.269 | 1.376 | 0.126 |
| 104 | MD-1 | 0.269 | 1.376 | 0.126 |
| 105 | MD-1 | 0.269 | 1.376 | 0.126 |
| 106 | MD-1 | 0.269 | 1.376 | 0.126 |
| 201 | MD-1 | 0.269 | 1.441 | 0.141 |
| 202 | MD-1 | 0.269 | 1.389 | 0.129 |
| 203 | MD-1 | 0.269 | 1.441 | 0.141 |
| 301 | MD-2 | 0.269 | 1.435 | 0.140 |
| 302 | MD-2 | 0.269 | 1.371 | 0.125 |
| 303 | MD-3 | 0.269 | 1.377 | 0.127 |
| 401 | MD-4 | 0.269 | 1.359 | 0.122 |
| 402 | MD-4 | 0.269 | 1.359 | 0.122 |
| 403 | MD-4 | 0.269 | 1.359 | 0.122 |
| 404 | MD-4 | 0.269 | 1.359 | 0.122 |
| 405 | MD-4 | 0.269 | 1.359 | 0.122 |

TABLE #3

Red Sensitive "Layer 5" Formula for Examples 101 through Example 405:

| Coating ID | Layer 5 Primary Cyan Dispersion | Layer 5 Primary Cyan Coupler | Layer 5 Primary Cyan Coupler g/$m^2$ | Layer 5 Secondary Dispersion | Layer 5 Coupler from Secondary Dispersion | Layer 5 Coupler from Secondary Dispersion g/$m^2$ | Layer 5 Gelatin g/$m^2$ | Layer 5 Silver g/$m^2$ |
|---|---|---|---|---|---|---|---|---|
| 101 | CD-1 | CC-4 | 0.423 | none | none | | 1.666 | 0.361 |
| 102 | CD-2 | CC-1 | 0.387 | none | none | | 2.351 | 0.264 |
| 103 | CD-3 | CC-1 | 0.430 | MD-1 | MC-1 | 0.037 | 2.327 | 0.253 |
| 104 | CD-3 | CC-1 | 0.430 | MD-1 | MC-1 | 0.066 | 2.347 | 0.263 |
| 105 | CD-3 | CC-1 | 0.387 | CD-11 | CC-5 | 0.036 | 2.398 | 0.285 |
| 106 | CD-3 | CC-1 | 0.301 | CD-11 | CC-5 | 0.106 | 2.526 | 0.340 |
| 201 | CD-2 | CC-1 | 0.387 | none | none | | 2.333 | 0.256 |
| 202 | CD-4 | CC-1 | 0.344 | none | none | | 2.343 | 0.260 |
| 203 | CD-5 | CC-1 | 0.280 | none | none | | 2.357 | 0.267 |
| 301 | CD-6 | CC-1 | 0.387 | none | none | | 1.802 | 0.235 |
| 302 | CD-7 | CC-1 | 0.280 | none | none | | 1.784 | 0.227 |
| 303 | CD-7 | CC-1 | 0.280 | none | none | | 1.784 | 0.227 |
| 401 | CD-7 | CC-1 | 0.280 | none | none | | 1.916 | 0.284 |
| 402 | CD-8 | CC-3 | 0.270 | none | none | | 1.984 | 0.314 |
| 403 | CD-8 | CC-3 | 0.270 | none | none | | 1.984 | 0.314 |
| 404 | CD-9 | CC-3 | 0.332 | none | none | | 2.024 | 0.332 |
| 405 | CD-10 | CC-3 | 0.415 | none | none | | 2.054 | 0.345 |

Image Stability

The image dye thermal stability was assessed by placing the processed separation exposure samples in a 70 degree C. oven kept at 50% RH. The density difference of the samples read before and after 56 days of treatment under these conditions is recorded in Table I through Table IV.

Dye Spectra Measurement:

Sample strips of the coatings were exposed to blue, green and red light through a separation exposure step tablet (density range 0–3, 0.15 increments) and developed in standard Kodak RA4 processing solutions before washing and drying. The resulting cyan, magenta, and yellow tracks were each read for reflection status A red, green and blue densities. Results are reported in Table I through Table IV.

Flesh to Neutral Assessment.

Prints were made from each coating using a Kodak Professional Portra NC film negative with a portrait scene with a Macbeth bar chart in the foreground and neutral background. The prints were colorimetrically balanced at on a 0.70 status A neutral step in the Macbeth chart. The six flesh patches on the Macbeth bar chart were read on a colorimeter and the average flesh patch colorimetric difference (ΔE) between the print and the original Macbeth chart was calculated and is reported in Table I through Table IV. The Caucasian 65 flesh patch ΔE is also reported separately. Each table represents a separate experiment and a separate matched printing event. The results of the flesh patch ΔE vary from printing event to printing event because the bar chart print matching was only done within an experiment.

Another negative containing a bride and groom portrait with a neutral background was evaluated where the prints were balanced to a visual match on the bride's check (close to the Caucasian 65 flesh position). The lighting for bride and groom scene produced a print where the groom's face includes flesh highlights to shadows ranging in lightness (L*) from 36 to 77. The flesh reproduction from highlight to shadows along with the neutrality of the background were subjectively evaluated. The results are reported as example 1 through example 4.

TABLE I

Example 1

| Sample | Layer 3 (Magenta) Dispersion | Layer 5 (Cyan) Dispersions | Layer 5 (Cyan) mole % non NB coupler | [a]Green Density | [b]Macbeth Caucasian patch 65 | [c]Macbeth Average flesh ΔE | [d]8 Wk 70 C., Red Density delta | Type |
|---|---|---|---|---|---|---|---|---|
| 101 | MD-1 | CD-1 | 100.0% | 0.320 | 1.90 | 7.87 | −.18 | Comp |
| 102 | MD-1 | CD-2 | 0.0% | 0.248 | 2.41 | 8.46 | −.06 | Comp |
| 103 | MD-1 | CD-3 and MD-1 | 9.1% | 0.312 | 1.39 | 7.81 | −.06 | Inv |
| 104 | MD-1 | CD-3 and MD-1 | 15.3% | 0.349 | 1.47 | 7.76 | −.06 | Inv |
| 105 | MD-1 | CD-3 and CD-11 | 10.0% | 0.318 | 1.74 | 7.88 | −.06 | Inv |
| 106 | MD-1 | CD-3 and CD-11 | 30.0% | 0.377 | 1.55 | 7.93 | −.06 | Inv |

[a]Green Density of Red Separation at 1.0 Status A Red
[b]Macbeth Chart Caucasian 65 Flesh patch ΔE vs original when balanced on a neutral
[c]Macbeth Chart Average ΔE for 6 flesh patches
[d]8 Week 50 Deg. C., 50% RH red density delta from 1.0.

Comparison coating 101 with cyan coupler CC-4 represents the state-of-the-art for flesh reproduction and flesh to neutral balance. It has low ΔE values for flesh patch reproduction, but exhibits poor cyan dye thermal stability. Comparison coating 102 with 100% narrow band (NB) cyan coupler has good thermal stability, but poor flesh reproduction when balanced on a neutral. Coatings 103 and 104 have both improved flesh to neutral and excellent thermal stability when non-NB magenta coupler MC-1 from dispersion MD-1 is blended with NB cyan coupler CC-1 from dispersion CD-3, as according to the invention. Coatings 105 and 106 have both improved flesh to neutral and excellent thermal stability when non-NB cyan coupler CC-5 is blended with NB cyan coupler CC-1, as according to the invention. In the flesh balanced bride and groom scene the neutral background color reproduction is improved in coating elements 103, 104, 105 and 106 compared to coating element 102.

TABLE II

Example 2

| Sample | Layer 3 (Magenta) Dispersion | Layer 5 (Cyan) Dispersions | Layer 5 (Cyan) mole % non NB coupler | [a]Green Density | [b]Macbeth Caucasian patch 65 | [c]Macbeth Average flesh ΔE | [d]8 Wk 70 C., Red Density delta | Type |
|---|---|---|---|---|---|---|---|---|
| 201 | MD-1 | CD-2 | 0.0% | 0.260 | 4.19 | 9.83 | −.07 | Comp |
| 202 | MD-1 | CD-4 | 20.0% | 0.293 | 2.00 | 7.89 | −.06 | Inv |
| 203 | MD-1 | CD-5 | 35.0% | 0.323 | 1.71 | 7.82 | −.05 | Inv |

[a]Green Density of Red Separation at 1.0 Status A Red
[b]Macbeth Chart Caucasian 65 Flesh patch ΔE Vs original when balanced on a neutral
[c]Macbeth Chart Average ΔE for 6 flesh patches
[d]8 Week 50 Deg. C., 50% RH red density delta from 1.0.

Comparison coating 201, similar to coating 102, has good thermal stability but poor flesh to neutral performance. Coatings 202 and 203, prepared according to the invention by blending non NB cyan coupler CC-3 with NB coupler CC-1, have improved flesh to neutral while maintaining excellent thermal stability. In the bride and groom scene the color reproduction of the neutral background is improved in coatings 202 and 203 compared to coating 201.

TABLE III

Example 3

| Sample | Layer 3 (Magenta) Disp. | Layer 3 (Magenta) Couplers | Layer 5 (Cyan) Disp. | Layer 5 (Cyan) mole % non NB coupler | [a]Green Density | [b]Macbeth Caucasian patch 65 | [c]Macbeth Average flesh ΔE | [d]8 Wk 70 C., Red Density delta | Type |
|---|---|---|---|---|---|---|---|---|---|
| 301 | MD-2 | MC-1 | CD-6 | 0.0% | 0.253 | 3.34 | 7.54 | −.06 | Comp |
| 302 | MD-2 | MC-1 | CD-7 | 35.0% | 0.320 | 2.26 | 7.08 | −.06 | Inv |
| 303 | MD-3 | MC-1 with 1.71 Mole % CC-4 | CD-7 | 35.0% | 0.321 | 1.14 | 6.13 | −.07 | Inv |

[a]Green Density of Red Separation at 1.0 Status A Red
[b]Macbeth Chart Caucasian 65 Flesh patch ΔE Vs original when balanced on a neutral
[c]Macbeth Chart Average ΔE for 6 flesh patches
[d]8 Week 50 Deg. C., 50% RH red density delta from 1.0.

Comparison coating 301 has good thermal stability but poor flesh to neutral performance. Coating 302 demonstrates the improvement of employing the blend of couplers of the invention in the cyan layer to improve flesh to neutral performance while maintaining good image stability. Coating 303 shows that further flesh to neutral improvement is obtained by modifying the magenta layer to include a small amount of a cyan coupler in the magenta layer. In the bride and groom scene the background neutrality of coatings 302 and 303 are improved compared to coating 301. The coating 303 flesh tone reproduction across the groom's face is significantly improved over coating 301 and improved vs. coating 302. The coating element 303 combination of cyan layer and magenta layer coupler blends in their respective layers yields the most improved flesh to neutral and flesh tone reproduction while maintaining excellent thermal stability.

TABLE IVA

Example 4 Format

| Sample | Layer 3 (Magenta) Dispersion | Layer 3 (Magenta) Couplers | Layer 5 (Cyan) Dispersion | Layer 5 (Cyan) mole % non NB coupler | Layer 1 (yellow) Description | Layer 1 (yellow) Coupler |
|---|---|---|---|---|---|---|
| 401 | MD-4 | MC-1 with 1.71 Mole % CC-4 | CD-7 | 35.0% | YD-3 | YC-2 |
| 402 | MD-4 | MC-1 with 1.71 Mole % CC-4 | CD-8 | 65.0% | YD-3 | YC-2 |
| 403 | MD-4 | MC-1 with 1.71 Mole % CC-4 | CD-8 | 65.0% | YD-4 | YC-1 |
| 404 | MD-4 | MC-1 with 1.71 Mole % CC-4 | CD-9 | 80.0% | YD-3 | YC-2 |
| 405 | MD-4 | MC-1 with 1.71 Mole % CC-4 | CD-10 | 100.0% | YD-3 | YC-2 |

TABLE IVB

Example 4 Results.

| Sample | [a]Green Density | [b]Macbeth Caucasian patch 65 | [c]Macbeth Average flesh ΔE | [d]8 Wk 70 C., Red Density delta | Type |
|---|---|---|---|---|---|
| 401 | 0.322 | 1.17 | 6.92 | −.06 | Inv |
| 402 | 0.381 | 1.43 | 6.69 | −.06 | Inv |
| 403 | 0.381 | 2.56 | 6.56 | −.06 | Inv |
| 404 | 0.406 | 3.21 | 7.61 | −.04 | Comp |
| 405 | 0.428 | 2.91 | 7.16 | −.03 | Comp |

[a]Green Density of Red Separation at 1.0 Status A Red
[b]Macbeth Chart Caucasian 65 Flesh patch ΔE Vs original when balanced on a neutral
[c]Macbeth Chart Average ΔE for 6 flesh patches
[d]8 Week 50 Deg. C., 50% RH red density delta from 1.0.

Coating 401 employs the combination of the coupler blend of the invention in the red recording layer with the coupler blend of the invention in the green recording layer, which results in a preferred flesh reproduction position, as shown in example 3. Coatings 402, 404 and 405 demonstrate the impact of increasing the amount of non-NB cyan coupler relative to the amount of NB cyan coupler. Coatings 404 and 405 demonstrate that 80 mol % and greater of the non-NB coupler CC-3 results in unacceptably large ΔE in the flesh patch reproduction. In the bride and groom scene coatings 401, 402 and 403 have the good neutral background color reproduction where the neutral background shifts too magenta in coatings 404 and 405. Coating 403 is identical in composition to coating 402 except for the blue recording layer, where coating 402 contains yellow coupler YC-2 and coating 403 contains YC-1. Both coatings 402 and 403 have good flesh reproduction and thermal stability, showing that the coupler blending in the cyan and/or magenta layers can be employed with a variety of yellow couplers.

The entire contents of the patents and other publications referred to in this specification are incorporated herein by reference.

What is claimed is:

1. A silver halide direct view multicolor photographic element comprising a red record containing (1) a red light sensitized silver halide emulsion, (2) a cyan dye-forming NB first coupler, and (3) a second coupler selected from (a) a magenta dye forming coupler in an amount of 2–30 mole % of the total coupler in the red record and (b) a cyan dye-forming coupler having a greater absorption in the green spectra than the first coupler in an amount sufficient to provide a Status A green density in the range of 0.27 to 0.40 using a red light separation exposure at a Status A red density of 1.0.

2. The element of claim 1 wherein the second coupler is a magenta dye-forming coupler.

3. The element of claim 2 wherein the second coupler is present in an amount of 2–25 mol % of the total coupler in the red record.

4. The element of claim 2 wherein the second coupler is present in an amount of 5–20 mol % of the total coupler in the red record.

5. The element of claim 2 wherein the magenta coupler in the cyan layer is a pyrazolone or pyrazoloazole coupler.

6. The element of claim 5 wherein the magenta coupler in the cyan layer is a 1H-pyrazolo (5,1-c) [1,2,4] triazole or a 1H-pyrazolo (1,5-b) [1,2,4] triazole compound.

7. The element of claim 1 wherein the second coupler is a cyan dye-forming coupler.

8. The element of claim 7 wherein the cyan dye-forming coupler is present in an amount sufficient to provide a Status A green density in the range of 0.27 to 0.40 at a Status A red density of 1.0.

9. The element of claim 8 wherein the cyan dye-forming coupler is present in an amount sufficient to provide a Status A green density in the range of 0.29 to 0.38 at a Status A red density of 1.0.

10. The element of claim 9 wherein the cyan dye-forming coupler is present in an amount sufficient to provide a Status A green density in the range of 0.31 to 0.36 at a Status A red density of 1.0.

11. The element of claim 7 wherein the second cyan dye-forming coupler is present in an amount of 5–75 mol % of the total coupler in the red record.

12. The element of claim 9 wherein the amount of the second cyan dye-forming coupler is 10–65 mol % of the total coupler in the red record.

13. The element of claim 7 wherein the cyan second coupler is a pyrroloazole-, a naphthol- or a 5-acylamino phenol-based coupler.

14. The element of claim 13 wherein the cyan second coupler is a 2,5-diacylamino phenolic coupler.

15. The element of claim 13 wherein the cyan second coupler is a 2-ureido, 5-acylamino phenolic coupler.

16. The element of claim 1 additionally comprising a green record containing a light sensitive magenta dye-forming coupler and a cyan dye-forming coupler in an amount of at least 0.1 mole % of the couplers present in the green record or comprising a green record having a Status A red density greater than 0.23 at a Status A green density of 1.0.

17. The element of claim 16 additionally comprising a green record containing a light sensitive magenta dye-forming coupler and a cyan dye-forming coupler in an amount of at least 0.1 mole % of the couplers present in the green record.

18. The element of claim 16 additionally comprising a green record having a Status A red density greater than 0.23 at a Status A green density of 1.0.

19. The element of claim 1 additionally comprising a reflective support.

20. The element of claim 1 additionally comprising a transparent support suitable for viewing a formed image by projection.

21. The element of claim 1 additionally comprising a transparent support suitable for permitting light transmission from the support side.

22. The element of claim 1 wherein the silver halide is at least 90% silver chloride.

23. The element of claim 1 containing in at least one layer thereof a surfactant compound comprising a block copolymer of propylene oxide and ethylene oxide.

* * * * *

UNITED STATES PATENT AND TRADEMARK OFFICE

CERTIFICATE OF CORRECTION

PATENT NO. : 6,555,304 B1
DATED : April 29, 2003
INVENTOR(S) : Walter H. Isaac et al.

It is certified that error appears in the above-identified patent and that said Letters Patent is hereby corrected as shown below:

Title page,
Item [75], Inventors, middle initial of last name Inventor is hereby corrected as shown below:
-- Carolyn R. Ellinger --

Signed and Sealed this

Ninth Day of September, 2003

JAMES E. ROGAN
*Director of the United States Patent and Trademark Office*